United States Patent [19]

Trudell

[11] 3,944,429

[45] Mar. 16, 1976

[54] CLEANING DEVICE

[76] Inventor: Erwin R. Trudell, 4237 W. Sacramento, Saint Louis, Mo. 63106

[22] Filed: Sept. 17, 1971

[21] Appl. No.: 181,308

[52] U.S. Cl. ..... 134/99; 134/103; 134/107; 134/199; 137/565

[51] Int. Cl. ..... B08b 3/02

[58] Field of Search ..... 134/94, 99, 103, 107, 199; 137/565, 565.2

[56] References Cited

UNITED STATES PATENTS

| | | | |
|---|---|---|---|
| 2,643,465 | 6/1953 | Douglass | 134/103 X |
| 2,651,191 | 9/1953 | Barnes | 134/94 X |
| 3,020,918 | 2/1962 | Albertson et al. | 134/99 X |
| 3,593,729 | 7/1971 | Goldware | 134/103 |

FOREIGN PATENTS OR APPLICATIONS

| | | | |
|---|---|---|---|
| 140,411 | 3/1948 | Australia | 134/94 |

*Primary Examiner*—Robert L. Bleutge
*Attorney, Agent, or Firm*—Roger M. Hibbits

[57] ABSTRACT

The present invention relates to a multipurpose washing, drying and painting device comprising a tank, nozzles mounted on the inner wall of said tank, a fluid supply operably coupled to said nozzles, an air supply operably coupled to nozzles mounted on said tank, a heater operably coupled to said tank, and recirculating hoses connecting the tank drain to a pujp in the fluid supply.

1 Claim, 2 Drawing Figures

INVENTOR
ERWIN R. TRUDELL
BY Roger M. Gibbita
ATTORNEY

CLEANING DEVICE

BACKGROUND OF THE INVENTION

Conventional devices for washing and drying and painting are contained in separate units and involve a duplication of parts and thus tend to cause the cost of such equipment, the space taken by such equipment to be excessive. Further, accessory or associated equipment increases cost and complexity.

SUMMARY OF THE INVENTION

It is therefore an object of the present invention to provide a washing, drying and paint spray device which combines all functions in one device.

Another object of the present invention is to provide such a device which washes using water sprayed under pressure.

A further object of the present invention is to provide such a device which is simply and economically manufactured and used.

A further object of the present invention is to provide such a device which is small, compact and portable and is of a construction such that it may economically be used in small garages and shops for cleaning parts and the area.

A further object of the present invention is to provide such a device which may readily be used for spraying and drying paint or spraying chemicals.

A further object of the present invention is to provide such a device which may readily be used in rural areas in conjunction with a well as a source of hot and cold water.

A further object of the present invention is to provide such a device which may readily be used in the reclamation of oil and water.

These together with other objects and advantages, which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 2:
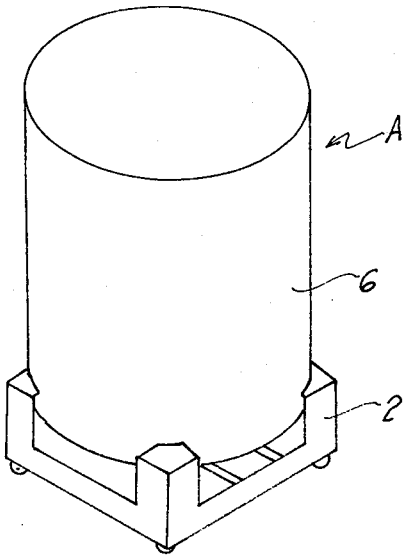
FIG. 2 is a perspective view of the framework of a multipurpose cleaning device constructed in accordance with and embodying the present invention.

Referring now in more detail and by reference characters to the drawings which illustrate practical embodiments of the present invention, FIG. 2 is a perspective view of the framework of a multipurpose cleaning device constructed in accordance with and embodying the present invention.

As shown in FIG. 2, framework A, comprises base means, 2, with tank means, 6, mounted thereon.

Further details of the construction of multipurpose cleaning device, 1, are shown in FIG. 2, which is a partial plan view and functional diagram of multipurpose cleaning device, 1.

Figure 1:
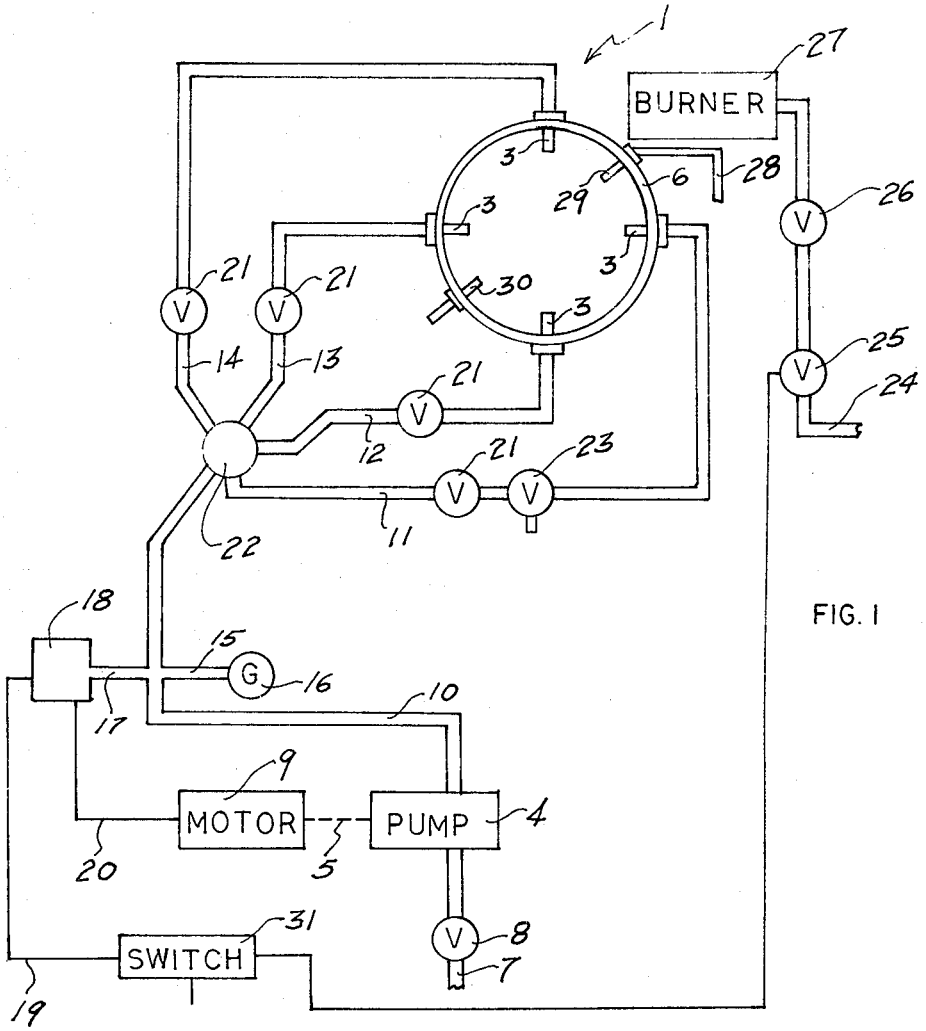
FIG. 1 is a partial plan view and functional diagram of a multipurpose cleaning device constructed in accordance with and embodying the present invention.

As shown in FIG. 1, tank means, 6, is shown provided with water nozzles or sprayers, 3, mounted on the interior wall of tank means, 6, and directed generally horizontally and towards the center of tank, 6.

As shown in FIG. 1, hose, 7, is coupled to a conventional water supply (not shown) and provides water through check valve, 8, to pump, 4, which is driven through conventional coupling indicated by dotted line, 5, by motor, 9. Pump, 4, supplies water under pressure to tank, 6, via pipe, 10, junction, 22, and pipes, 11, 12, 13, and, 14. Pipe, 15, couples pipe, 10, to pressure guage, 16. Pipe, 17, couples pipe, 10, to pressure limit switch, 18, which is electrically connected by wires, 19, and, 20, to a conventional source of electricity and motor, 9, respectively in such a manner to cause electric energy to motor, 9, to be shut off when the pressure at pressure limit switch, 18, exceeds a proscribed amount.

Water supplied to each nozzle, 3, is also controllable by manual valves, 21, provided in pipes, 11, 12, 13, and, 14. A take-off tap, 23, is provided in line, 11.

Not shown in the drawings is an additional nozzle, 3, installed in the top of tank, 6, pointing downward and near the center of tank, 6, with appropriate coupling to junction, 22, and an additional nozzle, 3, installed in the bottom of tank, 6, pointing upward and near the middle of tank, 6, with appropriate coupling to junction, 22.

Gas from a conventional gas source (not shown) is piped via pipe, 24, through electrically controlled solenoid valve, 25, shut off valve, 26, to burner, 27, which as operably mounted on base means, 2, and disposed near tank, 6.

Tank, 6, is also provided with air under pressure via air line, 28, to nozzle, 29, which are used in some of the operations of device, 1, in conjunction with fitting, 30.

In the use of device, 1, as a parts cleaning device a conventional rack (not shown) is mounted within tank, 6. Parts to be cleaned are placed upon the rack. A solvent such as tri-sodium diphosphate, is added in liquid form to tank, 6. Pump, 4, is activated by motor, 9, which is energized by switch, 31. Once device, 1, has been started and has sufficient liquid therein, it is stopped, the drain line from tank, 6, (not shown) is coupled to pump, 4, via pipe, 7, and the cleaning liquid is thereby recirculated.

Burner, 27, and its associated equipment is used to dry the parts previously cleaned.

In the use of device, 1, as a paint spraying device, a sealed paint container provided with input and output hoses is placed in tank, 6. The input hose is coupled to nozzle, 29, and the output hose is coupled to the inner side of fitting, 30, and a conventional spray hose is coupled to the outer side of fitting, 30.

For recirculating oil, water and other fluids, the drain to tank, 6, (not shown) is coupled to pump, 4, via pipe, 7. A suitable filter, not shown, is provided in line, 7.

Hose take-off, 23, is provided for use with a conventional garden hose for area cleaning.

It should be understood that changes and modifications in the form, construction, arrangement, and combination of the compound injection device and methods of making and using the same may be made and substituted for those herein shown and described without departing from the nature and principle of my invention.

Having thus described my invention, what I claim is new and desire to secure by United States Letters Patent is:

1. A parts washer/dryer for cleaning and drying machine parts comprising, housing means, tank means operably mounted in said housing means, said tank means provided with drain means, a plurality of nozzles mounted on the interior surface of the top, bottom and sides of said tank means and directed towards the center of said tank means, pump means operably mounted in said housing means, said pump means operably coupled to said nozzles to provide liquids to said tank means, heating means operably mounted in said housing means and conductively coupled to said tank means, air inlet and outlet means operably mounted on said tank means, said air inlet and outlet means disposed apart from said nozzles and inoperative during use of said nozzles, liquid control means operably coupled between said nozzles and said pump means, hose means, said hose means connected at one end to the input of said pump means and connected at the other end to liquid supply means, said liquid supply means being either fresh liquid or the drain means of said tank means, pressure sensing means operably disposed between said pump means and said nozzles, said pressure sensing means operably coupled to said pump means and adopted to turnoff said pump if the pressure at the output of the pump exceeds a predetermined amount.

* * * * *